US006471442B1

(12) United States Patent
Deeb et al.

(10) Patent No.: US 6,471,442 B1
(45) Date of Patent: Oct. 29, 2002

(54) SLIP FORM PAVER

(75) Inventors: Mahmoud Deeb, Unkel-Scheuren; Jakob Gehlen, Bornheim-Roisdorf, both of (DE); Raymond Smolders, Herentals (BE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 09/647,213

(22) PCT Filed: Feb. 22, 1999

(86) PCT No.: PCT/EP99/01129

§ 371 (c)(1),
(2), (4) Date: Sep. 28, 2000

(30) Foreign Application Priority Data

Mar. 30, 1998 (DE) ..... 198 14 052

(51) Int. Cl.[7] ..... G01C 19/12; G01C 19/22
(52) U.S. Cl. ..... 404/96; 404/105
(58) Field of Search ..... 404/96, 105, 106

(56) References Cited

U.S. PATENT DOCUMENTS 1,782,707 A * 11/1930 Bayley ..... 404/96
3,970,405 A * 7/1976 Swisher, Jr. et al. ..... 404/105
4,197,032 A * 4/1980 Miller ..... 404/98
4,586,889 A * 5/1986 Krohne et al. ..... 425/456
4,778,305 A * 10/1988 Ritchey et al. ..... 404/105
4,789,266 A * 12/1988 Clarke, Jr. et al. ..... 404/96
4,900,186 A * 2/1990 Swisher, Jr. et al. ..... 404/105
5,590,977 A * 1/1997 Guntert et al. ..... 404/101
5,615,972 A * 4/1997 Guntert et al. ..... 404/72
5,647,688 A * 7/1997 Guntert et al. ..... 404/101
6,022,170 A * 2/2000 Rower ..... 404/96

* cited by examiner

*Primary Examiner*—Gary S. Hartmann
(74) *Attorney, Agent, or Firm*—Diller, Ramik & Wight

(57) ABSTRACT

A slip-form paver is provided in the form of a tractor (2) including a machine frame (4) having substantially parallel longitudinal beams (8) at opposite ends of which are track assemblies (14). The machine frame (4) includes a base frame (20) and telescopic cross beams (18) located between the base frame (20) and the longitudinal beams (8). An intermediate frame (24) is located beneath the base frame (20) and is selectively vertically adjustable. Two working mechanisms (28, 32) are in transverse relationship to the longitudinal beams (8), and the latter are transversely shiftable to selectively lengthen or shorten the overall transverse working width of the paver.

34 Claims, 11 Drawing Sheets

102
20
104
108
112
116
118
XIII
8

FIG.16
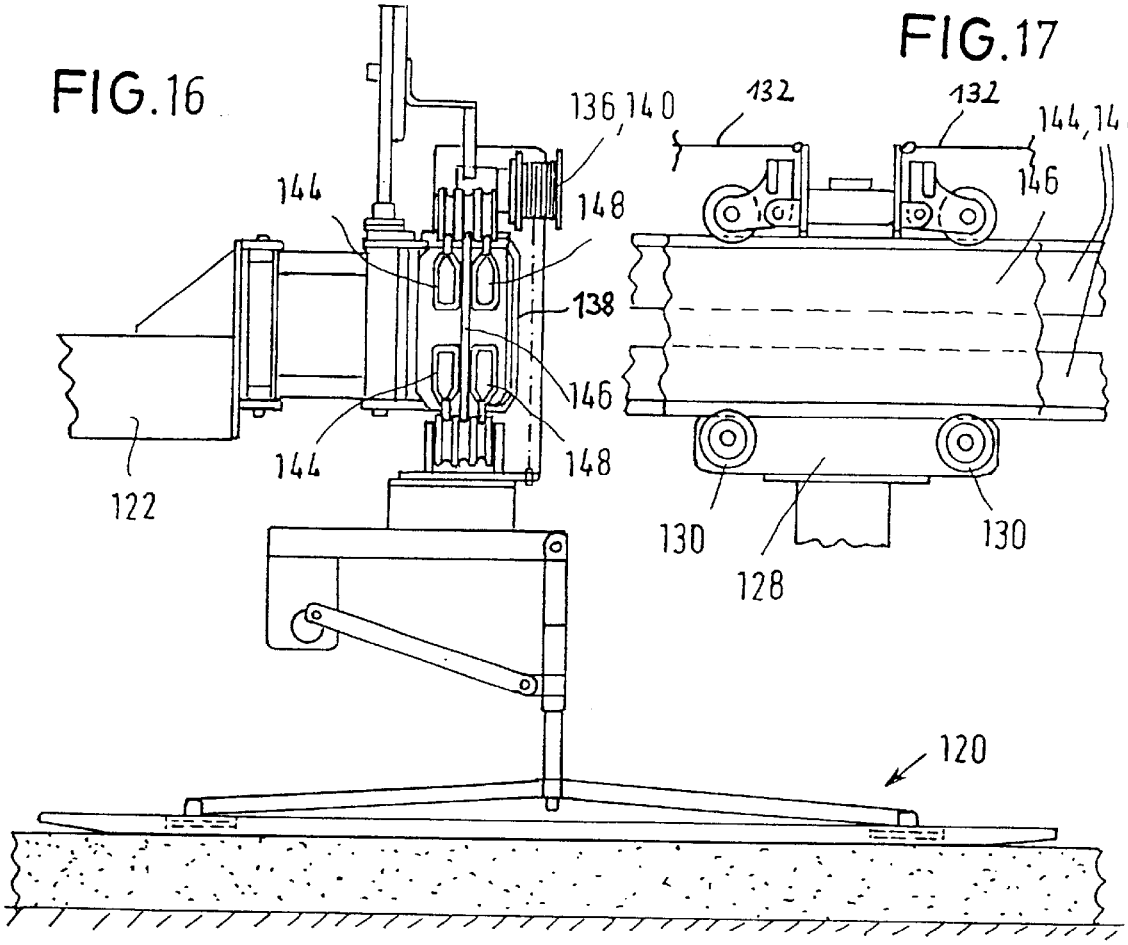
FIG.17
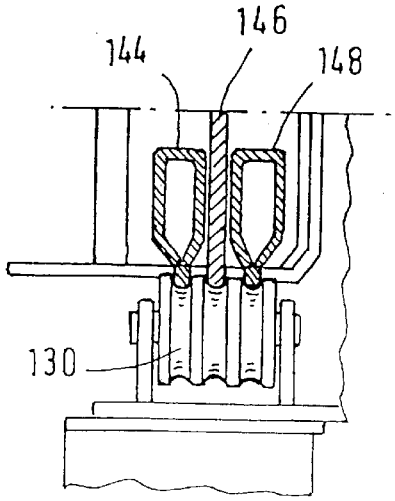
FIG.18

SLIP FORM PAVER

THE INVENTION

The invention relates to a slip-form paver.

Such slip-form pavers are required for making concrete road surfaces. Known slip-form pavers comprise a tractor consisting of a machine frame and four track assemblies carrying different working means for spreading and smoothing the concrete.

Since the desired width of the concrete lanes can vary, for example at merging lanes, a rearrangement of the slip-form paver is often required which can take a restructuring time of two to three days depending on the necessary extent of the restructuring work.

Such interruption of the work is undesirable so that slip-form pavers have been developed which have machine frames that can the widened telescopically (WO95/28525).

While ii is relatively simple to change the frame width of the machine frame telescopically, severe problems may arise if at the same time also the working means have to be telescopically changed in the working width. Problems occur, in particular, with the setting of a correct roof-shaped profile of the concrete paving when changing the working width, since a change of the working width simultaneously causes a change in the height of the concrete troughs at the outer edges so that the entire slip-form paver has to be leveled again.

Therefore, it is an object of the present invention to improve a slip-form paver of the type mentioned above such that necessary restructuring works for changing the working width are minimized.

SUMMARY OF THE INVENTION

The invention advantageously provides that the machine frame has a base frame in which the telescopically operable cross beams are supported, that an intermediate frame is arranged below the base frame, the distance from the base frame being adjustable, and that the intermediate frame is mounted with a working means divided over the working width and adaptable to the working width without any mounting work. The intermediate frame allows for a vertical adjustment of the working means relative to the base frame, whereby changes occurring due to a changed working width may be compensated by the vertical adjustment.

Preferably, it is provided that the working means is stationarily articulated at the longitudinal beams on the outer side and, on the inner side, the working means is articulated and supported for transverse displacement at the intermediate frame. Thus, it can be made sure that with a working means set under an angle, the angle set will be maintained even when the working width is changed so that no new setting of the angular position is required.

For example, the working means is made up by two concrete troughs arranged in succession in the working direction and together cover the working width set. The concrete troughs are also provided with a lateral form. When the machine frame is telescoped, the concrete troughs can also be displaced relative to each other.

The intermediate frame may be connected to the base frame via a plurality of commonly adjustable vertical adjustment means. The commonly adjustable vertical adjustment means allow for a parallel vertical displacement of the intermediate frame relative to the base frame. Here, the angle of inclination of the concrete troughs can be adjusted between 0° and 3° at most.

The longitudinal beams are each connected to the bas frame through two telescopically extendable cross beams and a piston-cylinder unit. Such a structure has a high stability. At the end of the longitudinal beams, the track assemblies may be pivoted through 90°. Thus, the slip-form paver can be moved in the transverse direction and may for example be moved onto a flatbed trailer.

The track assemblies may be coupled to the longitudinal beams using a parallelogram suspension. The parallelogram suspension allows for a change of the track width of the slip-form paver without a change of the frame width.

In a preferred embodiment of the invention, it is provided that the base frame is mounted with a transverse rail guide having at least two telescopically movable rails, and that a carriage for a working means is movable in the transverse direction on the rail guide. Such a device advantageously allows for the displacement of a working means over the entire working width, with no restructuring work required even when the working width is altered.

The carriage has a plurality of rollers with parallel adjacent running grooves corresponding in number to the number of rails so that at least one of the running grooves engages one of the rails. In this manner, the carriage may always be displaced over the entire working width regardless of the working width set.

Preferably, the carriage is moved on the rail guide using a traction rope.

One traction rope is fastened to beach end of the carriage, a rope winch with a drive being arranged on the longitudinal beams or the track assemblies. Only one drive at a time can be driven on one side of the slip-form paver.

In an advantageous embodiment, the carriage is connected to flexible hydraulic lines supplied via a hose reel. The hydraulic connection on the carriage makes it possible to supply hydraulic oil to hydraulic drives of the working means mounted on the carriage.

The working means may be, for example, a vertically adjustable distributing knife.

At the front of the base frame, a vertically adjustable front wall may be mounted having a telescopically movable wall element on both sides thereof. With the telescopically movable wall elements, the front wall can be adapted to a changed working width of the slip-form paver without any restructuring and, when the machine frame is telescopically widened, it may be automatically extended to the required working width.

The front wall elements are articulately connected to the front wall, on the one hand, and to the longitudinal beam, on the other hand, to which they are connected articulately and vertically adjustably. Thereby, the angle of inclination of the front wall elements can be adjusted.

The working means mounted on the carriage may also be a longitudinal smoothing board attached to the rear o the base frame. In this case, the lateral ends may be connected with the track assemblies so that the rail guide is longer than the working width of the slip-form paver.

The longitudinal smoothing board is coupled to the base frame via two connecting rods so that a longitudinal displacement of the longitudinal smoothing board is possible with a parallel inward or outward displacement of the track assemblies.

Further, the base frame may be mounted with a transverse smoothing board consisting of two board segments hingedly connected in the middle of the working width to form a roof-shaped profile.

The angle of inclination of the board segments may be adjustable via a piston-cylinder unit acting between the board segments. A stop limits the inclination angle downward so that negative inclination angles cannot be set.

The board segments or extension boards fastened thereto may have transversely extending slide rails on which the longitudinal beams can slide in the transverse direction so that the board segments or their extensions can laterally project beyond the longitudinal beams. In this way, it is ensured also for a transverse smoothing board that an adaptation to different working width is possible in a wide range and that with a larger adjustment of the working width, only extension members must be mounted or disassembled.

It is provided that the board segments are fastened to the longitudinal beams so as to be vertically adjustable.

The following is a detailed description of an embodiment of the invention:

In the Figures:

BRIEF DESCRIPTION OF THE DRAWINGS

FIG. 6 illustrates the intermediate frame with the concrete troughs fastened there in, FIG. 16 is a side elevational view of a longitudinal smoothing board, partly in cross section, FIG. 17 is top plan view on the rail guide of the longitudinal smoothing board, FIG. 18 is an enlarged illustration of the rail guide of the longitudinal smoothing board.

DESCRIPTION OF THE PREFERRED EMBODIMENTS

Figure 1:
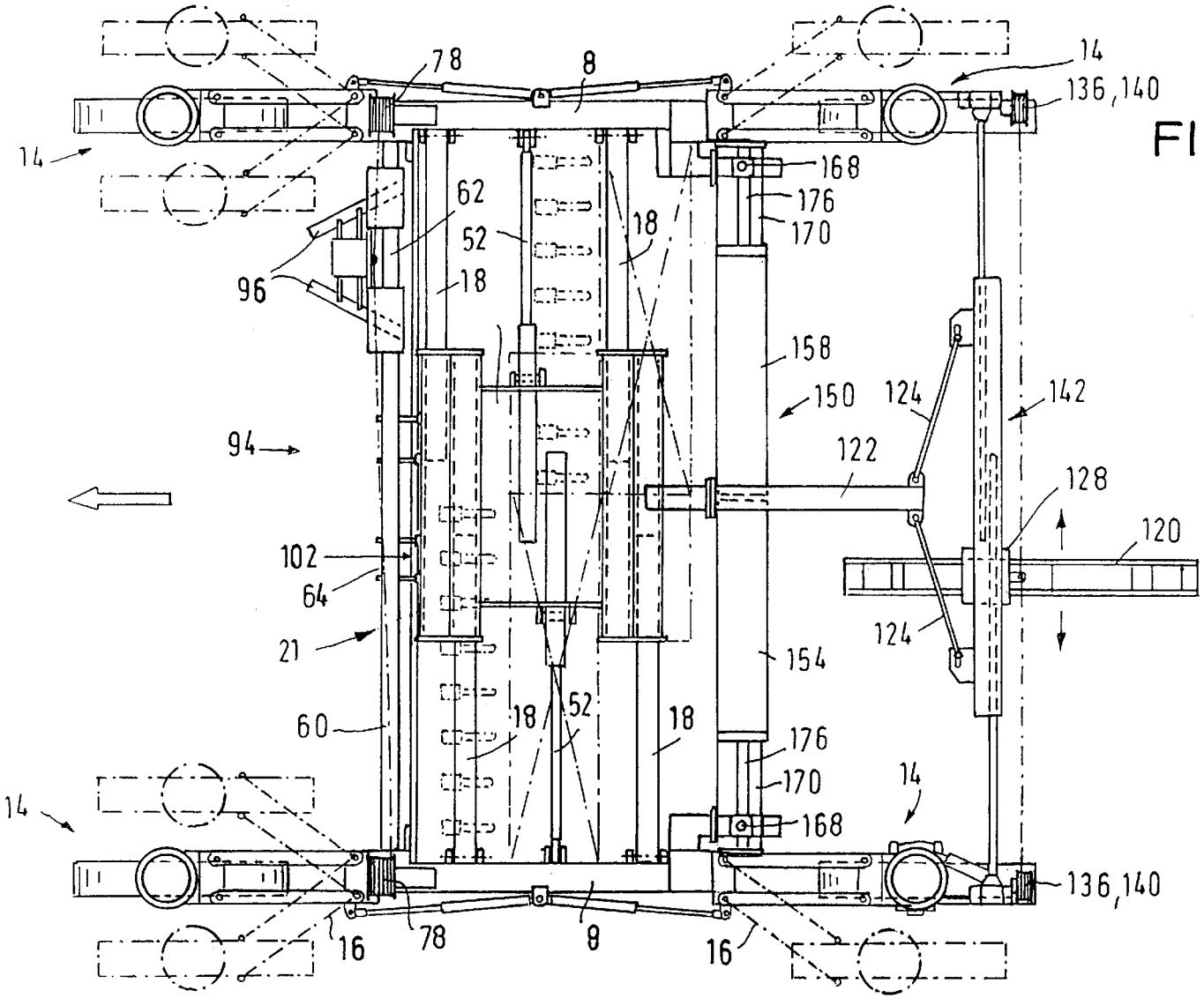
FIG. 1 is a top plan view on the slip-form paver.

The slip-form paver has a tractor 2 consisting of a machine frame 4 with longitudinal beams 8 extending in parallel to the working direction and telescopically movable cross beams 18 extending transverse to the working direction for variably adjusting the working width. The cross beams are supported in a base frame 20, a total of four cross beams 18 projecting-from a base frame arranged in the middle of the working width and being connected with the longitudinal beams 8.

The cross beams 18 are mutually offset in the base frame 20 so that, for example, the working width may be varied between 3 m and 6 m. The cross beams 18 may also be adapted for double telescopic extension should substantially larger working widths be desired to be set.

At the front and the rear end of the longitudinal beams 8, a respective track assembly 14 is articulately fastened guided in a parallelogram-like manner. The parallelogram guiding that allows for a track width adjustment without changing the working width, two parallelogram connecting rods 16 are provided, respectively, for articulately connecting the track assemblies 14 with the longitudinal beam.

Figure 19:
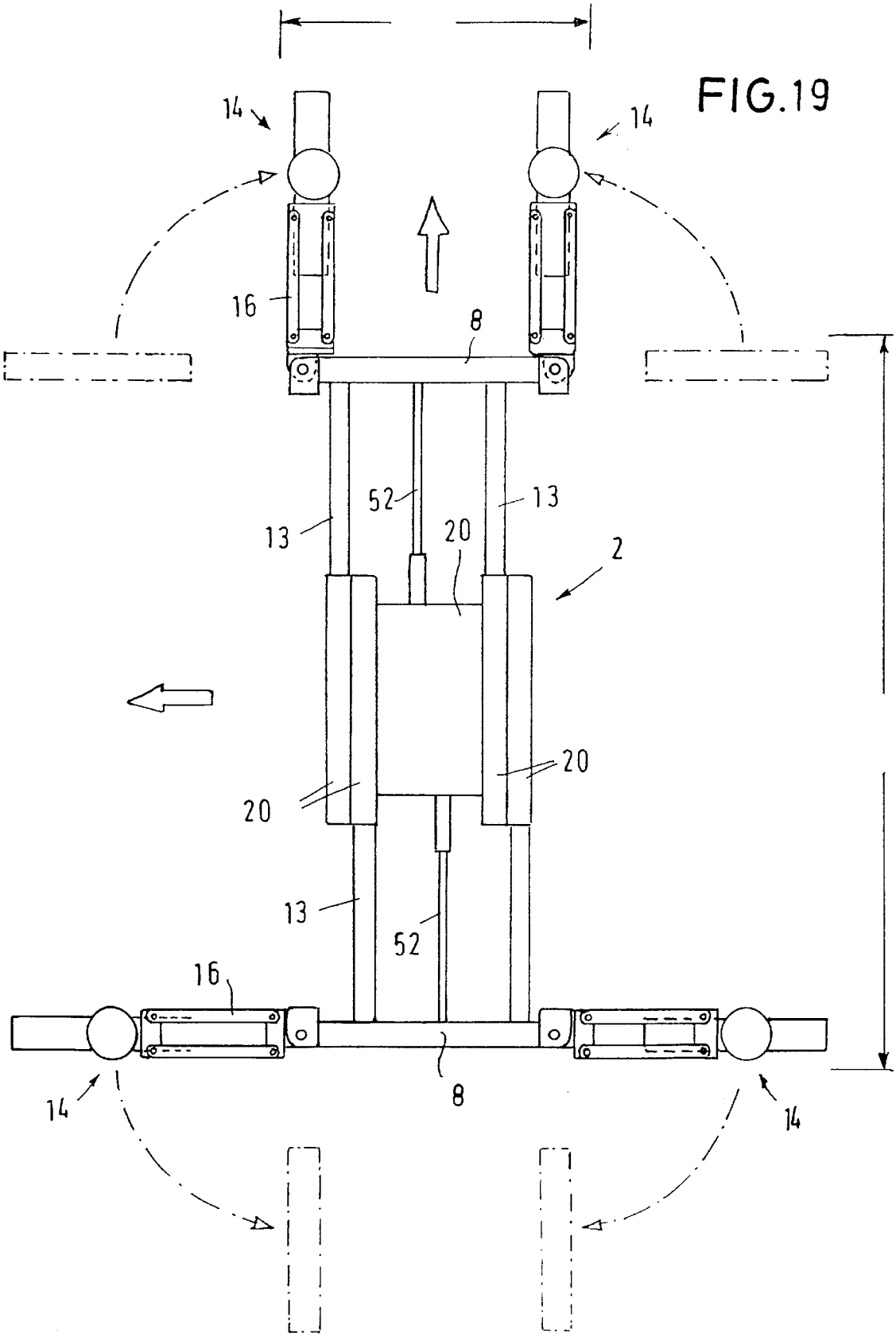
FIG. 19 is a schematic representation of the pivotability of the track assemblies.

Moreover, the track assemblies at the ends of the longitudinal beams 8 can be pivoted through an angle of 90° so that the slip-form paver can be loaded onto a flatbed trailer transversely to its working direction without exceeding the maximum allowed transport width (FIG. 19).

Further, the track assemblies allow for a vertical adjustment of the machine frame in a manner known per se.

Figure 5:
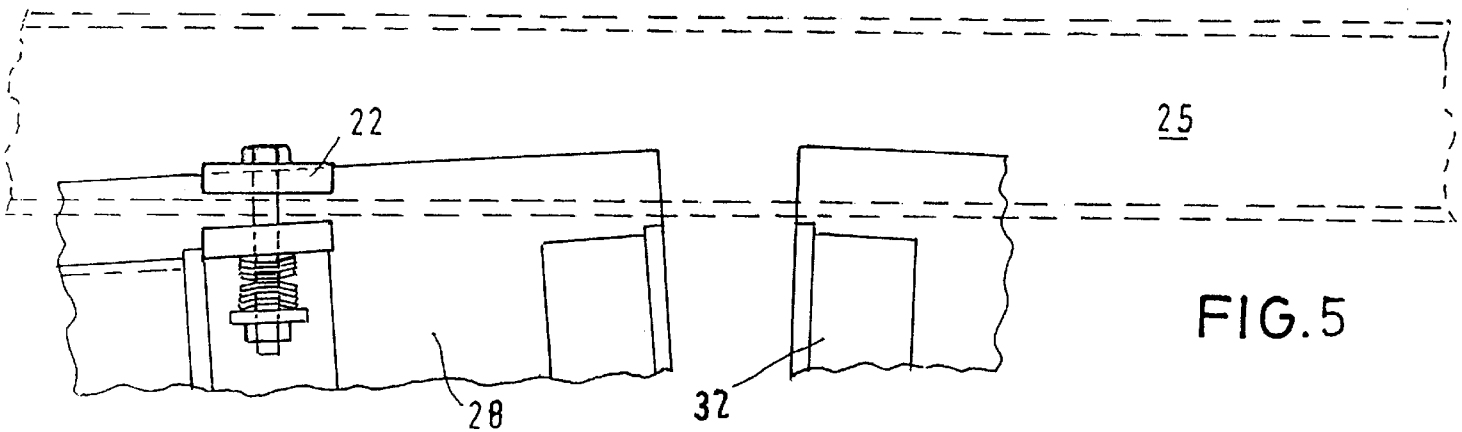
FIG. 5 illustrates the detail V in FIG. 4.
Figure 6:
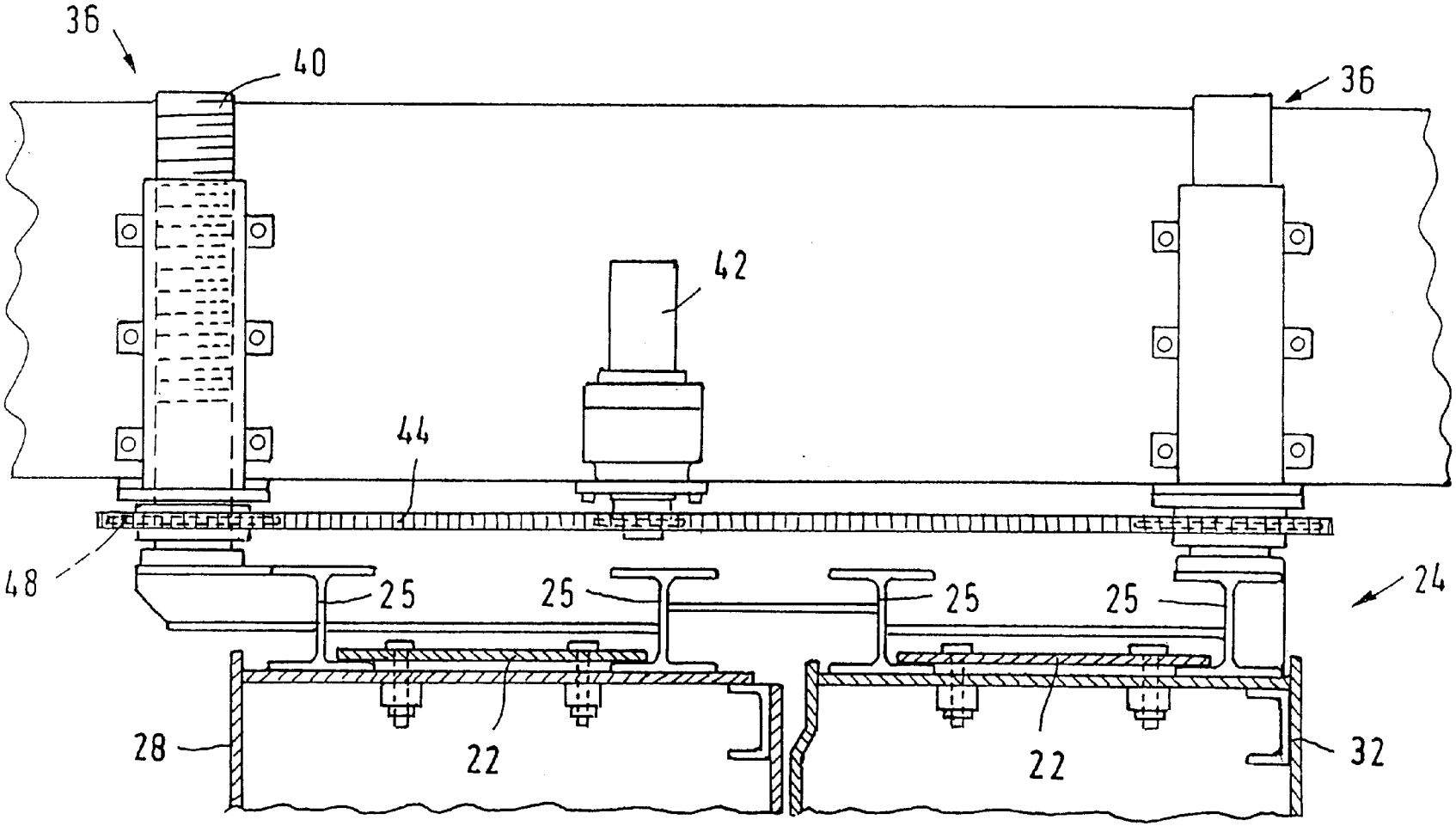
Figure 7:
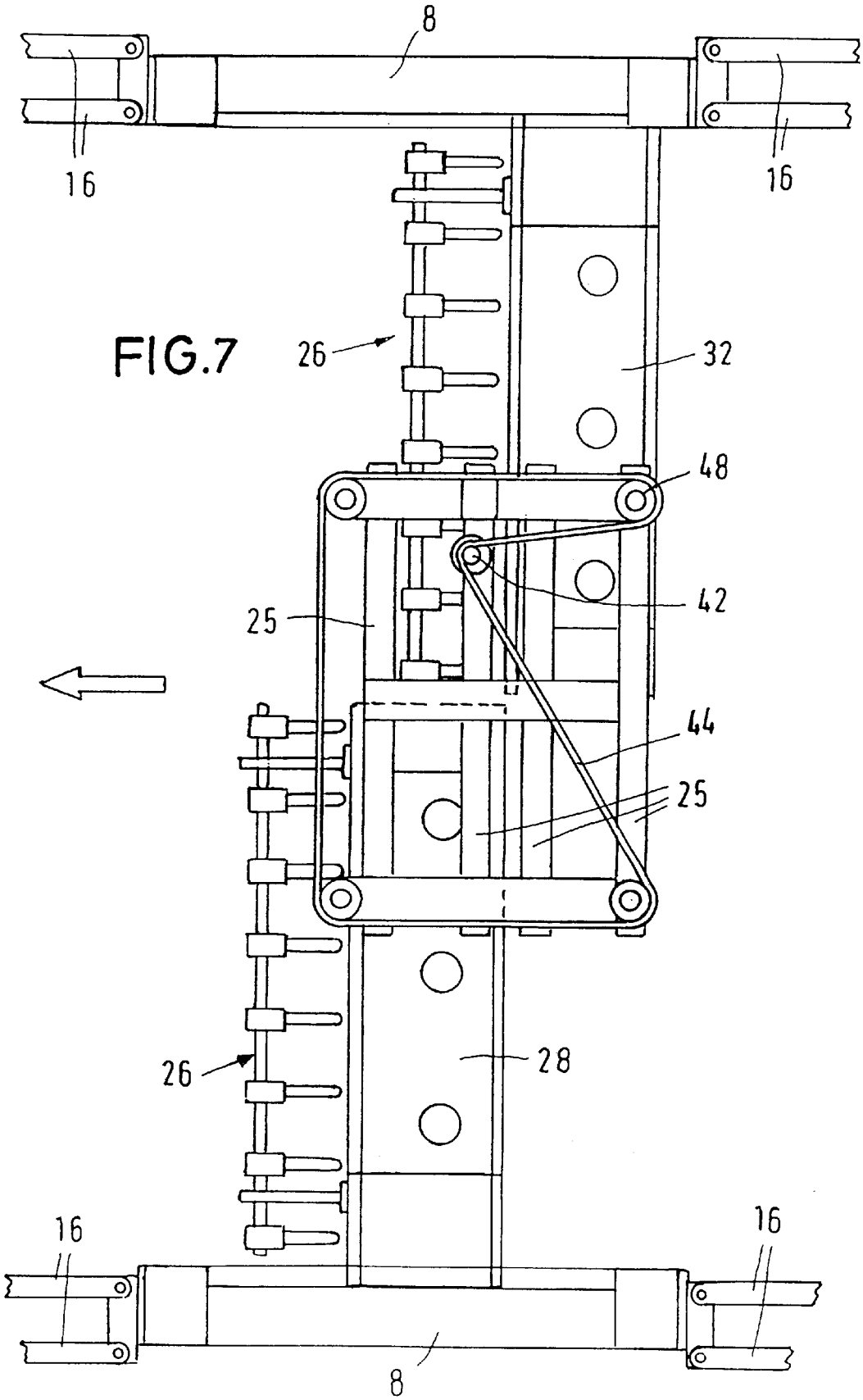
FIG. 7 is a top plan view on the concrete troughs with vibratory liquefying means.

As best seen in FIG. 6, the base frame 20 is mounted with an intermediate frame 24, the distance to the base frame being adjustable. Using the intermediate frame 24, working means such as concrete troughs 28, 32 may be adjusted vertically relative to the base frame 20. As evident from FIGS. 1 and 2, the concrete troughs 28, 32 are arranged successively in the working direction, together covering the working width set. The concrete troughs 28, 32 are fixedly mounted in an articulated manner on the outside of the longitudinal beams 8. When the working width is telescopically changed through the cross beams 18, the concrete troughs 28,32 are automatically extended or narrowed as well. In doing so, the upper edges of the concrete troughs 28, 32 slide in the intermediate frame 24 that may be provided with four double T profiles, for example, for guiding the concrete troughs 28, 32 (FIG. 6). The concrete troughs 28, 32 are articulately supported at the intermediate frame 24 for transverse displacement. The hinge is formed by a clamping strip 22 clamping one leg of the double T profile 25 with spring bias (FIG. 5 and FIG. 6).

When changing the working width, the inclination angle of the concrete troughs 28, 32 also changes.

Using the vertical adjustment of the intermediate frame 24, the desired inclination angle of the concrete troughs 28, 32 can very quickly be set without a new leveling of the slip-form paver being necessary. By means of the vertical adjustment means 38 a roof angle between 0 and 3°, for example, may be set quickly. The vertical adjustment means 36 may be a spindle and nut drive. The nut has a pinion 48 on its exterior and is held fixed in the axial direction relative to the base frame 20. A continuously running chain 44 driven by a drive motor 42 with a pinion, is coupled with all four spindle nuts so that all vertical adjustment means 36 are driven simultaneously and uniformly. In the embodiment illustrated in the Figs., four vertical adjustment means 36 are provided between the base frame 20 and the intermediate frame 24. As an alternative, a combination of piston cylinder units and a path measuring system may be used as the vertical l adjustment means 36.

In front of the concrete troughs 28, 32, seen in the traveling direction, liquefying means 26 consisting of several vibratory bottles are provided in a conventional manner, which means are preferably also supported at the in termediate frame 24.

The outer ends of the concrete troughs 28, 32 are hinged to a supporting arm connected to the longitudinal beams 8 and have a lateral form 34 at their free ends.

Figure 8:
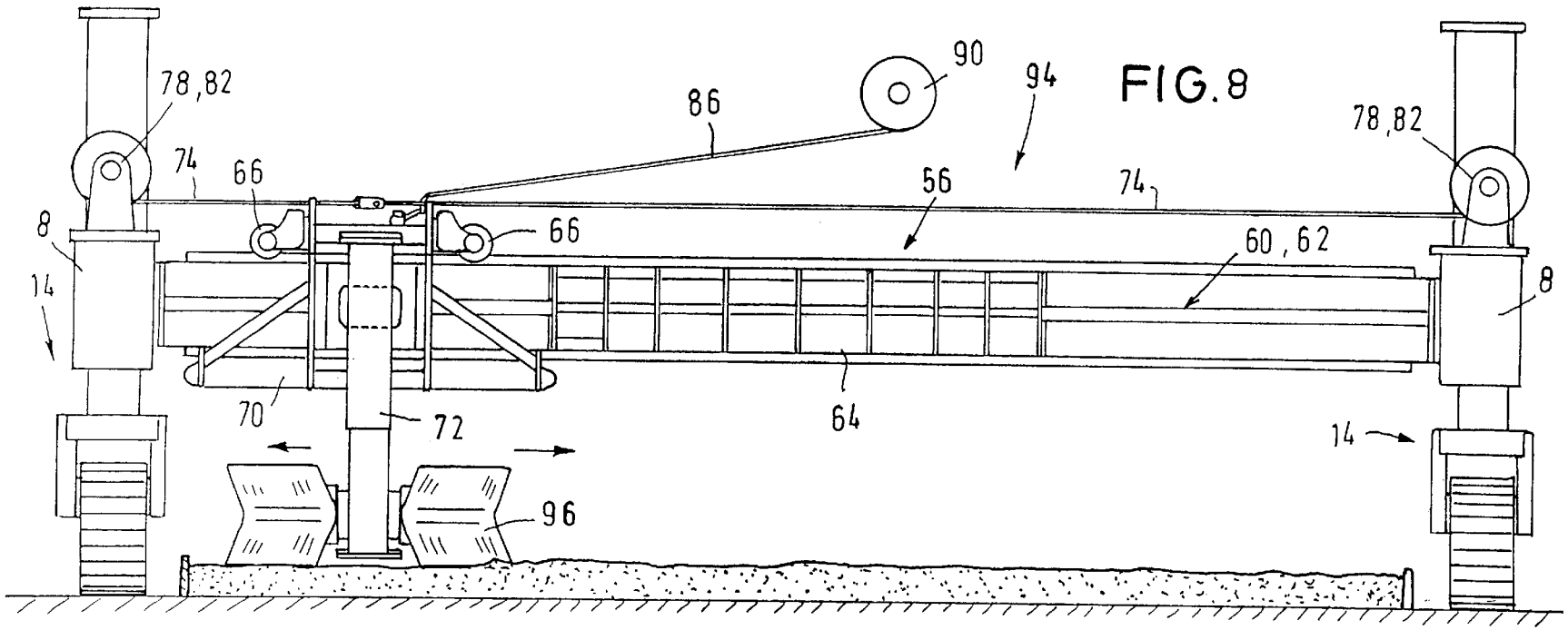
FIG. 8 illustrates a distributing knife.
Figure 9:
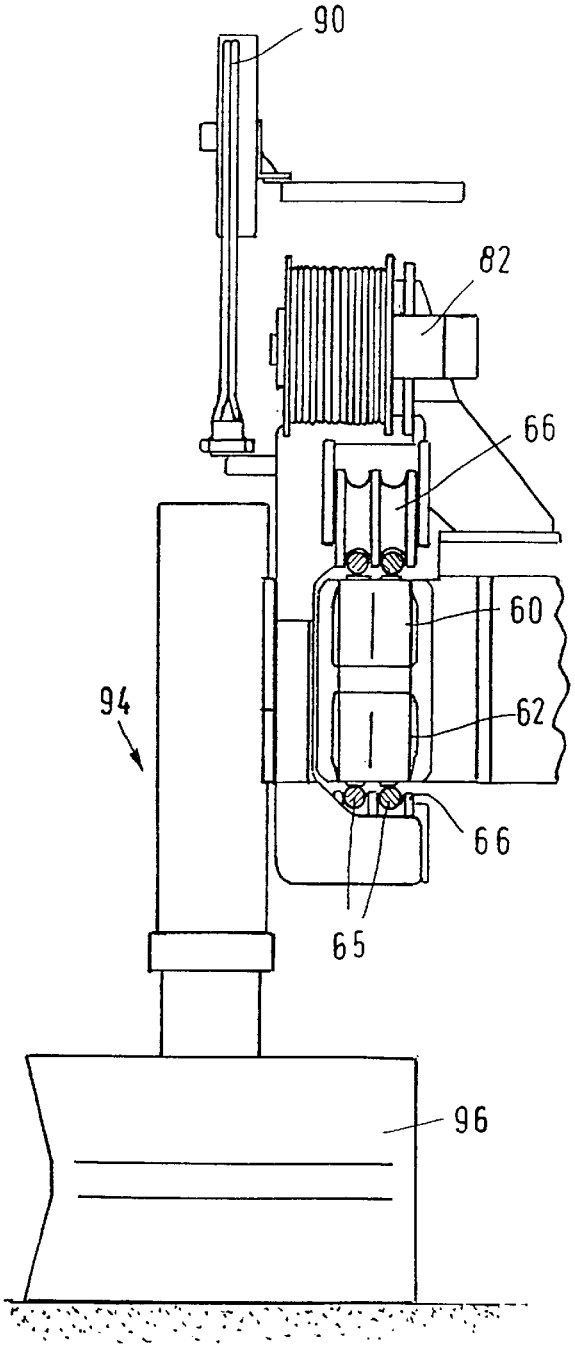
FIG. 9 is a side elevational view of the distributing knife.
Figure 10:
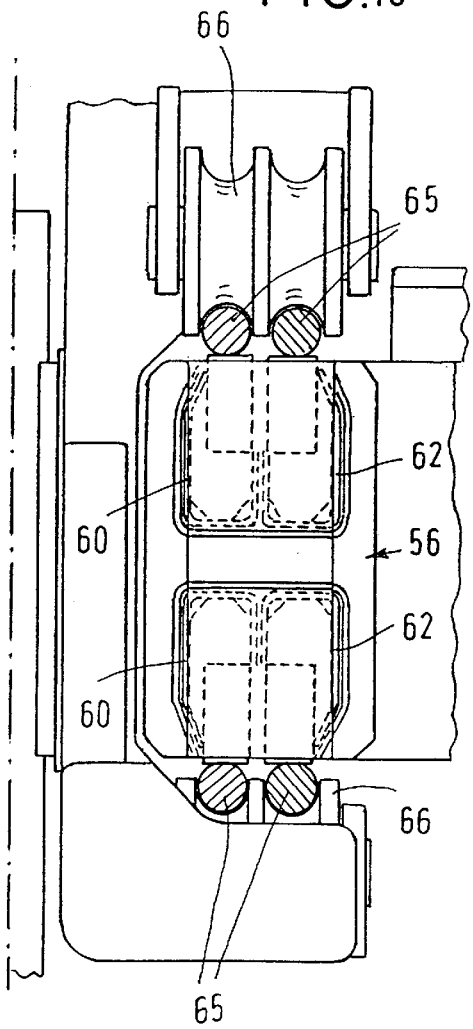
FIG. 10 is an enlarged view of the rail guide of the distributing knife.

FIGS. 8 to 10 illustrate a distributing knife 94 with a vertically adjustable plough-like knife 96 adapted to be displaced over the entire working width by means of a carriage 70 and a rail guide 56.

The carriage 70 is moved using a traction rope 74, a rope winch 78 with a drive 82 being provided on the longitudinal beam 8. The rope winch drives 82 are hydraulic motors. Only one motor is driven at a time, the carriage 70 moving to the left or the right in the drawing, depending on which motor is driven.

The lifting cylinder 72 is supplied through wound flexible hydraulic conduits 86 which may be wound from a hose reel 90 fastened on the machine frame 4, for example, and which are kept under tension. Preferably, this hose reel 90 is fastened to the base frame 20. A schematic cross section of the carriage 70 is illustrated in FIGS. 9 and 10. The rail guide 56 is a hollow central member 64 accommodating a total of four extractable slide rails 60, 62. The slide rails 60, 62 can be telescopically extended cross-wise to the left or the right together with the machine frame 6, since the slide rails 60, 62 are screwed at their lateral ends to the longitudinal beams 8 via an end plate.

The rails 60, 62 each have round rods 65 on their exterior, on which the twin rollers 66 of the carriage 70 roll.

The carriage 70 has two laterally and vertically spaced twin rollers 66, respectively, embracing the upper and lower rails 60, 62. With telescopic rails 60, 62, at least one rolling groove of the rollers 66 is in contact with one round rod 65.

Due to the rope traction drive of the carriage 70, telescoping the machine frame automatically telescopes the distributing knife 94 without any restructuring needed.

Figures 11, 12, 13:
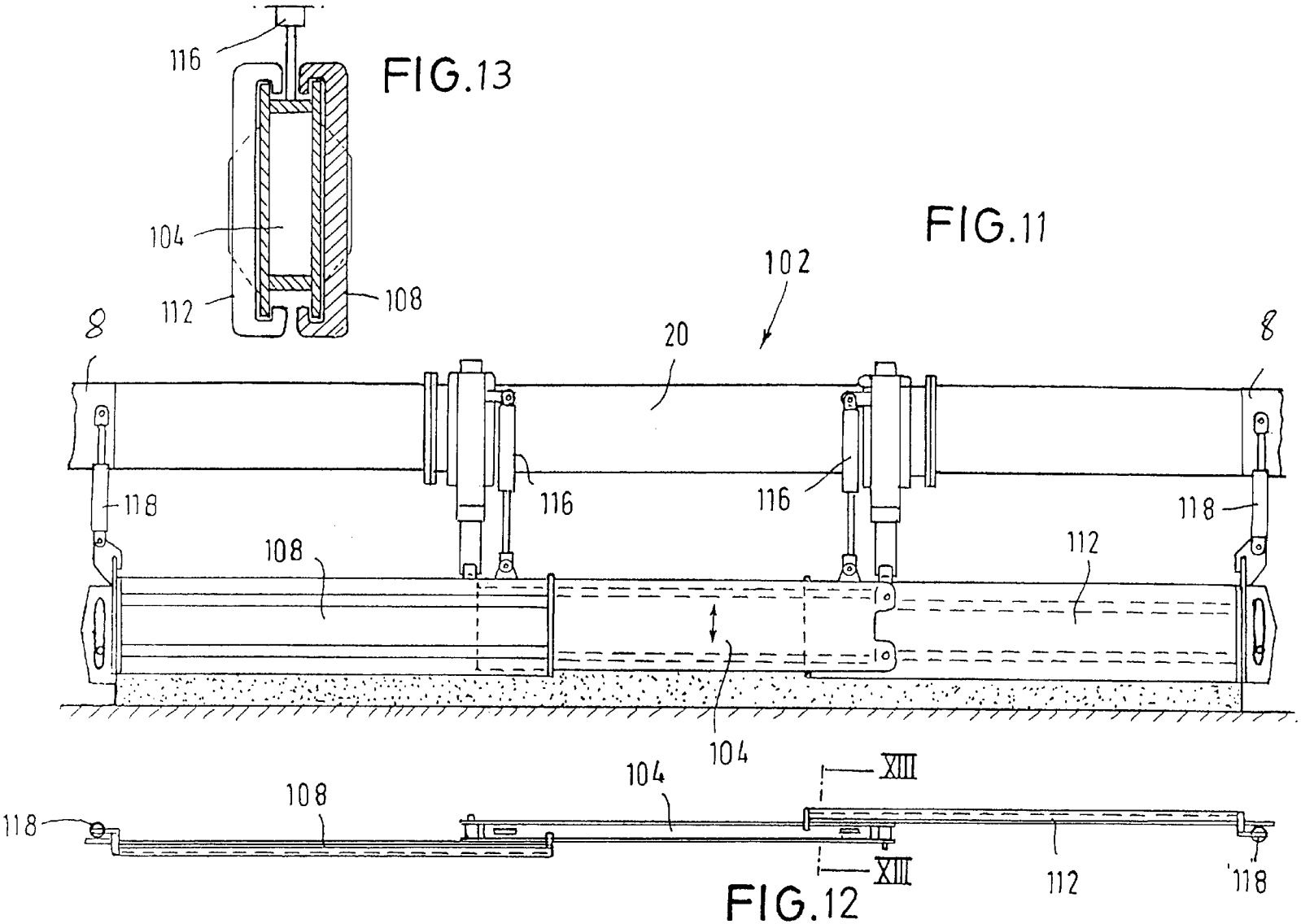
FIG. 11 illustrates a telescopically movable front wall.
FIG. 12 is a top plan view on the front wall.
FIG. 13 is a cross sectional view along line XIII—XIII in FIG. 12.

FIGS. 11, 12 and 13 illustrate a variable front wall 102 comprising a fixed central member 104 and two telescopically movable front wall elements 108, 112 arranged successively in the working direction, as best seen in FIG. 12.

The outer front wall elements 104, 108 are connected to the longitudinal beams 8 through a dog and are telescopically displaced when the machine frame is extended during a change of the working width. The central member 104 is vertically adjustable in parallel using two lifting cylinders 116 fastened at the base frame 20.

The telescopically movable front wall elements 108, 112 are hingedly supported in elongated holes 110 in the longitudinal beams 8 and can also be lifted or lowered at their outer ends by means of a lifting cylinder 118.

The telescopically movable front wall elements 104, 108 embrace, as is best seen in FIG. 13, the central front wall member 104 in form fit, but with sufficient play so that the front wall elements 108, 112 are also telescopically movable when a roof profile is set.

Figure 14:
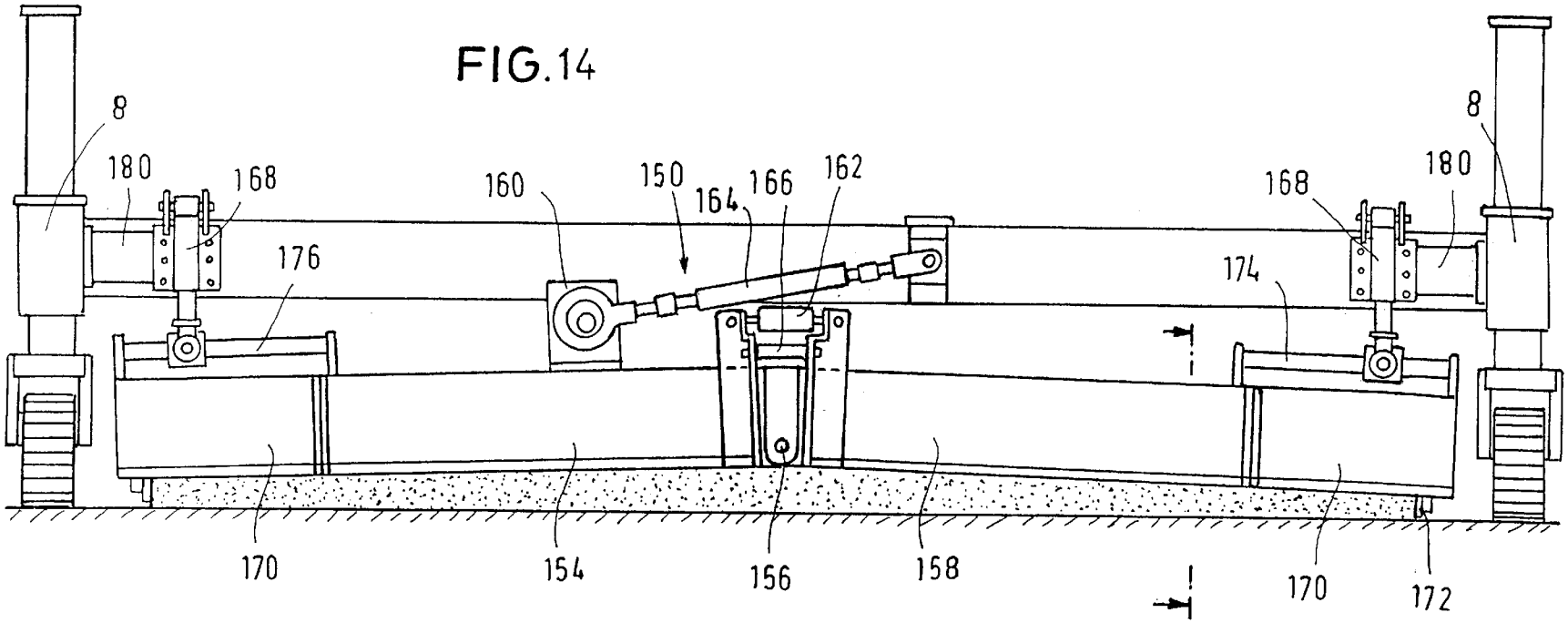
FIG. 14 is a front view of a transverse smoothing board.
Figure 15:
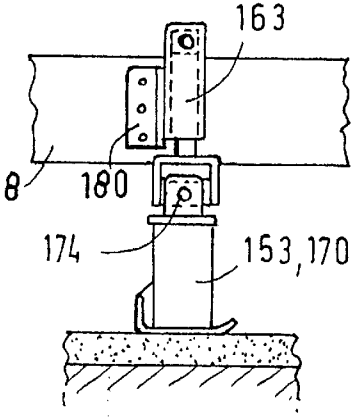
FIG. 15 is a side elevational vie of the transverse smoothing board.

FIGS. 14 and 15 illustrate an embodiment of a transverse smoothing board 150. The transverse smoothing board 150 comprises two board segments 154, 158 of about 2.20 m in width connected at their lower edge by a hinge 156 in the middle of the machine so as to make setting a roof profile possible; Above both board segments 154, 158, a piston-cylinder unit 162 is provided horizontally for pressing both board segments 154, 158 apart. To make sure that the two board segments 154, 158 do not hang down in a V-profile form, a sleeve 166 limits the distance between two reference points of the board segments 154, 158.

On both sides of the board segments 154, 148 extension boards 120 may be fastened by screwing.

By means of an eccentric drive 160, an oscillating transverse movement of the transverse smoothing board may be obtained using a push rod 164.

The outer ends of the board segments 154, 158 or the extensions 170 (as illustrated in FIG. 14), a sliding guide 174, 176 may be mounted. The sliding guides 174, 176 are fastened to the longitudinal beam 8 by means of a vertical adjustment means 168 and a connecting member 180.

The connecting member 180 can slide for about 700 mm on each sliding guide 174, 176. Thus, the transverse smoothing board allows for a change in width of the tractor 2 of about 1.40 m without any restructuring. When the working width is reduced by 1.40 m, the board segments 154, 158 or the extension boards 170 project for about 70 cm beyond the machine frame on the left and on the right. Using the vertical adjustment means 168, the transverse smoothing board is manually vertically adjustable through a spindle. This adjustment is within the range of millimeters and serves to correct the surface to its desired finishing thickness.

Figure 2:
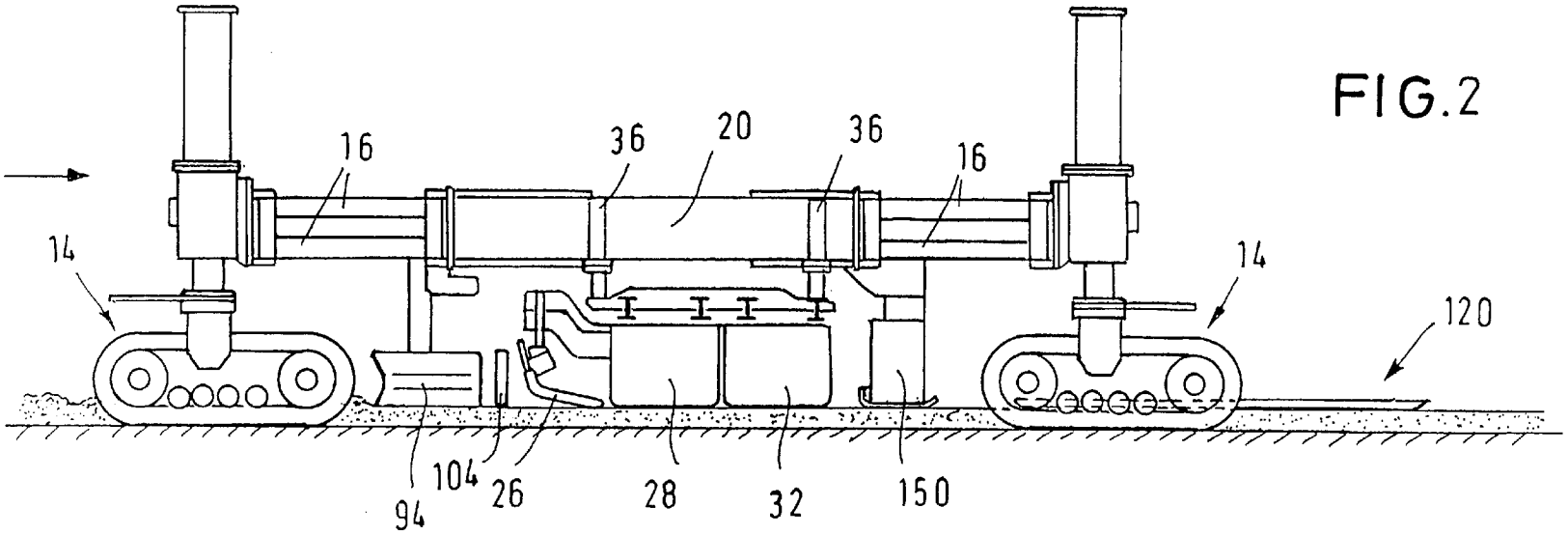
FIG. 2 is a side elevational view of FIG. 1.
Figure 3:
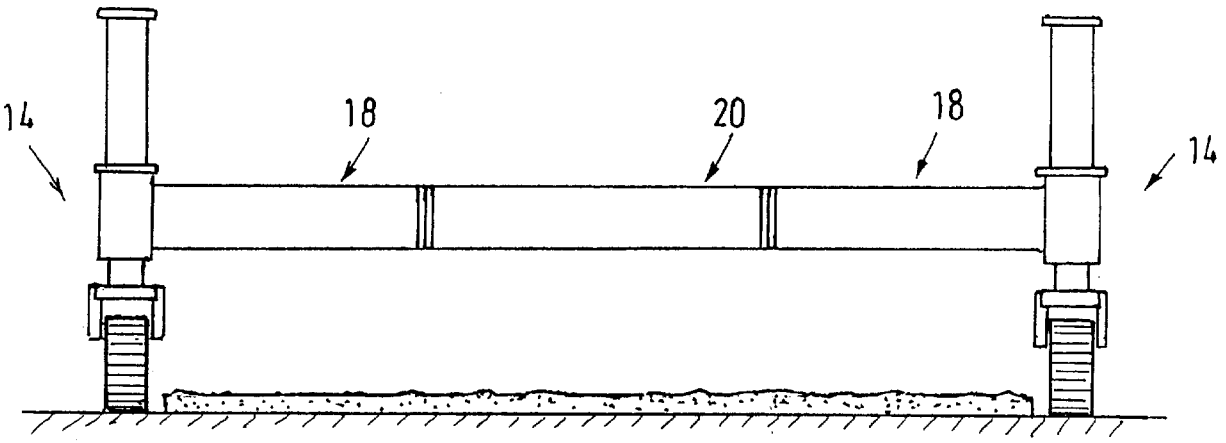
FIG. 3 is a front view of the machine frame.
Figure 4:
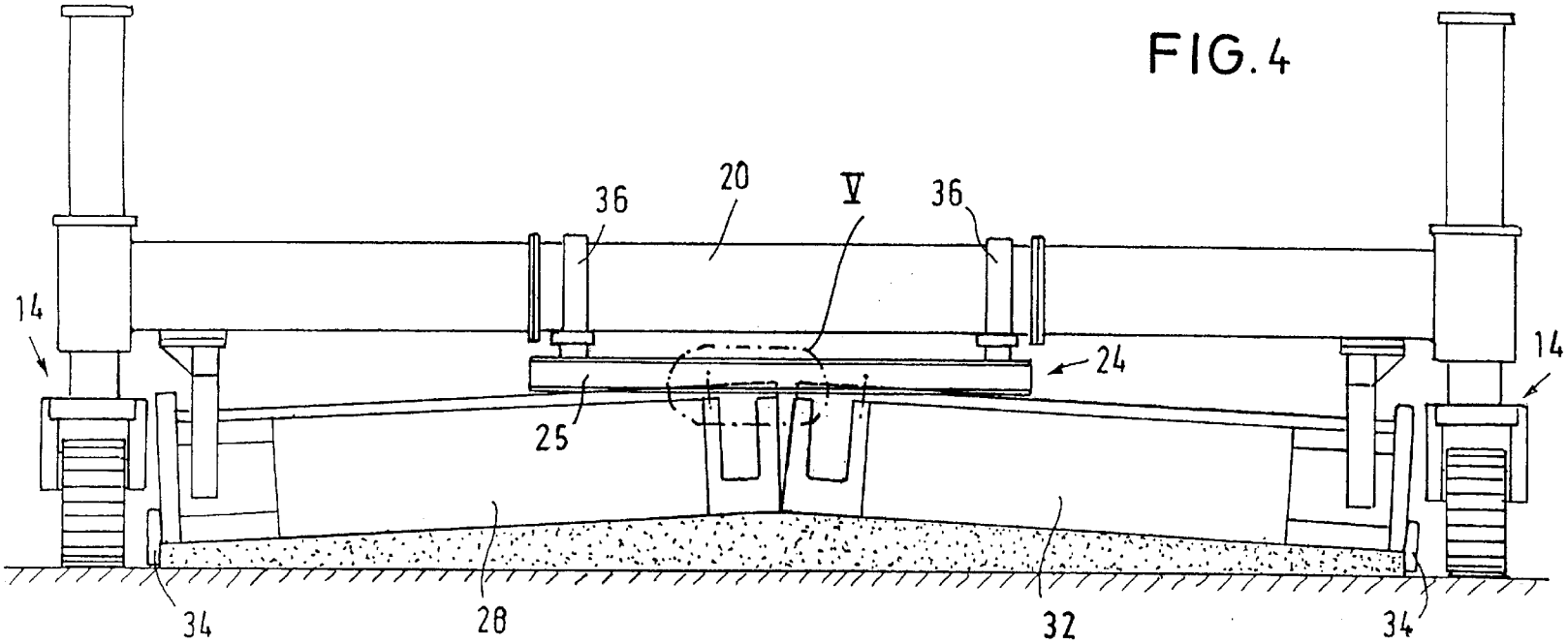
FIG. 4 is a front view of the concrete troughs.

FIGS. 16 to 18 illustrate a longitudinal smoothing board 120 mounted, as is best seen in FIG. 1, to the base frame 20 or the intermediate frame 24 by a beam 122 extending in parallel to the working direction. Similar to the distributing knife 94, the longitudinal smoothing board 120 may be moved with a carriage 128 over the entire working width and beyond, when the track width of the running gears 14 is enlarged.

The stationary middle member 138 of the rail guide 142 accommodates two laterally extractable sliding rails 144, 148, as in the embodiment of FIG. 10. The stationary middle member 138 simultaneously forms a third sliding rail 146. The four roller 130 of the carriage 128 each have three running grooves, at least one of which is in engagement with one of the rails 144, 146, 148.As is evident from FIG. 17, the carriage 128 embraces the downward and upward protruding rails 144, 146, 148 with the laterally and vertically spaced rollers 130.

The carriage 128 is driven via a traction rope 132 that can be wound up on both sides of the rail guide 142 using a rope winch 136 and the associated drive 140. Different from the embodiment in FIGS. 8 to 10, the rope winches 136 are not located on the longitudinal beam 8 but on the track assemblies 14, as is best seen in FIG. 1.

Upon a parallel displacement of the track assemblies 14, the rails 144, 148 of the longitudinal smoothing board 120 can be extended beyond the working width of the slip-form paver. Since, as evident from FIG. 1, the parallel displacement of the track assemblies 14 entails a change in the distance between the longitudinal smoothing board 122 and the base frame 20, the longitudinal smoothing board 122 is coupled to the beam 122 by two connecting rods 124. The connecting rods 124 are guided in elongated holes on the front side of the rail guide 142, seen in the working direction, so that the relative position of the longitudinal smoothing board 122 to the base frame 20 can adjust when the track width is changed.

As in the embodiment of figs. 8 to 10, the longitudinal smoothing board 122 may also be connected via a hose reel to flexible hydraulic hoses for the oscillating operation of the smoothing board.

Although a preferred embodiment of the invention has been specifically illustrated and described herein, it is to be understood that minor variations may be made in the apparatus without departing from the spirit and scope of the invention, as defined the appended claims.

What is claimed is:

1. A slip-form paver comprising a tractor (2) including a machine frame (4) having substantially parallel longitudinal beams (8), track assemblies (14) at opposite ends of said longitudinal beams (8), said machine frame (4) including a base frame (20), telescopic cross beams (18) located between said base frame (20) and said longitudinal beams (8) for selectively varying the working width of the paver, an intermediate frame (24) located beneath said base frame (20), means (36) for adjusting the vertical distance of said intermediate frame (24) relative to said base frame (20), two working means (28, 32) disposed in transverse relationship to said longitudinal beams (8), means (22, 25) for supporting said two working means (28, 32) relative to said intermediate frame (24), means for supporting said two working means relative to said longitudinal beams (8), and said supporting means (22, 25) for supporting said two working means (28, 32) relative to said intermediate frame (24) being constructed and arranged for effecting movement of said two working means (28, 32) relative to said intermediate frame (24) to selectively lengthen or shorten the overall transverse length of said two working means (22, 25) and thereby accommodate to a desired working width of the paver.

2. The slip-form paver as defined in claim 1 wherein said means (22, 25) for supporting said two working means (28, 32) relative to said intermediate frame (24) are in transverse displaceable relationship to each other.

3. The slip-form paver as defined in claim 1 wherein said means (22, 25) for supporting said two working means (28, 32) relative to said intermediate frame (24) are in transverse sliding relationship to each other.

4. The slip-form paver as defined in claim 1 wherein said two working means (28, 32) are two concrete troughs disposed successively in the working direction of said paver and collectively define and span the maximum working width of said paver.

5. The slip-form paver as defined in claim 1 wherein said intermediate frame vertical adjusting means (36) includes a plurality of vertical adjusting means (36), and means (42, 44, 48) for simultaneously adjusting said vertical adjusting means (36).

6. The slip-form paver as defined in claim 1 wherein said telescopic cross beams (18) are constructed and arranged for twice telescopic extendable movement.

7. The slip-form paver as defined in claim 1 wherein said longitudinal beams (8) are connected to the base frame (20) through two telescopic cross beams (18) and a piston-cylinder unit (52) of the latter.

8. The slip-form paver as defined in claim 1 wherein said track assemblies (14) are located at ends of said longitudinal beams (8), and means for effecting pivotal movement of said track assemblies (14) through 900.

9. The slip-form paver as defined in claim 1 including a parallelogram guide (16) connecting each track assembly (14) to an associated longitudinal beam (8).

10. The slip-form paver as defined in claim 1 including a front wall (104) carried by said base frame (20), a pair of front wall elements (108, 112) located on opposite sides of said front wall (104), means for articulately connecting said front wall elements (108, 112) to said front wall (104), and means for articulately and vertically adjustably connecting said front wall elements (108, 112) to respective ones of the longitudinal beams (8).

11. The slip-form paver as defined in claim 1 including a front wall (104) carried by said base frame (20), a pair of front wall elements (108, 112) located on opposite sides of said front wall (104), and means for articulately connecting said front wall elements (108, 112) to said front wall (104).

12. The slip-form paver as defined in claim 11 wherein said articulately connecting means slidably connect said front wall elements (108, 112) to the front wall 104, and means adjustably connecting said front wall elements (108, 112) to respective ones of the longitudinal beams (8).

13. The slip-form paver as defined in claim 1 wherein said base frame (20) includes at least one transverse rail guide (56; 142) having at least two relatively movable rails (60, 62; 144, 146, 148), and a carriage (70, 128) movable along said at least one transverse guide rail (56; 142).

14. The slip-form paver as defined in claim 13 wherein said carriage (70; 128) includes a plurality of rollers (66; 130), each roller including substantially parallel running grooves corresponding in number to the number of rails (60, 62; 144, 146, 148), and at least one of the running grooves engages one of the rails.

15. The slip-form paver as defined in claim 13 wherein the carriage (70; 128) is movable on the rail guide (56; 142) through a traction element (74; 132).

16. The slip-form paver as defined in claim 15 wherein on both sides of the carriage (70; 128) one of each longitudinal beam (8) and the track assemblies (14) are provided with a drum (78, 136) and a drum drive (82, 140) upon which is wound a free end of the traction element (74; 132).

17. The slip-form paver as defined in claim 15 wherein on both sides of the carriage (70; 128) one of each longitudinal beam (8) and the track assemblies (14) are provided with a drum (78, 136) and a drum drive (82, 140) upon which is wound a free end of the traction element (74; 132), and means for driving only one drum drive (82; 140) at a time.

18. The slip-form paver as defined in claim 13 including a flexible hydraulic line (86) connected to the carriage (70; 128) by a reel (90).

19. The slip-form paver as defined in claim 13 including a distributor knife (94) carried by and vertically adjustable relative to a front side (21) of the base frame (20).

20. The slip-form paver as defined in claim 13 including a longitudinal smoothing board (120) carried by a rear side of the base frame (20).

21. The slip-form paver as defined in claim 20 wherein ends of the rails (144, 148) are connected to the track assemblies (14).

22. The slip-form paver as defined in claim 20 wherein the longitudinal smoothing beam (120) is connected to the base frame (20) through two connecting rods (124) effecting displacement of the longitudinal smoothing beam (120) in a longitudinal direction when the track width of the track assemblies (14) is changed.

23. The slip-form paver as defined in claim 1 including a transverse smoothing beam (150) carried by said base frame (20), and said transverse smoothing beam (150) includes two beam segments (154, 158) hinged substantially medially of the working width of the paver to form an adjustable roof profile.

24. The slip-form paver as defined in claim 23 wherein one of the beam segments (154, 158) and extension boards (170) connected to the beam segments (154, 158) are provided with transverse slide rails (174) on which the longitudinal beams (8) slide in a transverse direction so that the beam segments (154, 158) can project laterally beyond the longitudinal beams (8).

25. The slip-form paver as defined in claim 24 wherein one of the beam segments (154, 158) and extension boards (170) are connected to the longitudinal beams (8) for vertical adjustment.

26. A slip-form paver comprising a tractor (2) including a machine frame (4) having substantially parallel longitudinal beams (8), track assemblies (14) at opposite ends of said longitudinal beams (8), said machine frame (14) including a base frame (20), telescopic cross beams (18) located between said longitudinal beams (8) for adjusting the transverse working width of the paver, at least one transverse rail guide (56; 142) mounted transversely between said longitudinal beams (8), said at least one transverse rail guide (56; 142) including at least two relatively movable rails (60, 62; 144, 146), a carriage (70; 128) movably mounted for displacement along said rail guides (56; 142); a rope drum (78, 136) and an associated rope drum drive (140) located at one of each longitudinal beam (8) and track assembly (14), and a rope (74) connected to said carriage (70; 128) and wound upon each rope drum (76, 136) for effecting transverse displacement of said carriage (70; 128).

27. The slip-form paver as defined in claim 26 including a hydraulic line reel (90) carried by the carriage (70; 128), and a flexible hydraulic line (86) wound upon the hydraulic line reel (90).

28. The slip-form paver as defined in claim 26 including a distributor knife (94) vertical adjustably mounted at a front side (21) of said base frame (20).

29. The slip-form paver as defined in claim 26 including a longitudinal smoothing (120) mounted at a rear side of said base frame (20).

30. The slip-form paver as defined in claim 29 wherein ends of the movable rails (144, 148) are connected to the track assemblies (14).

31. The slip-form paver as defined in claim 29 including a longitudinal smoothing beam (120) connected by connecting rods (124) to the base frame (20) for effecting displacement of the longitudinal smoothing beam (120) in the work direction when the track width of the track assemblies (14) is changed.

32. A slip-form paver comprising a tractor (2) including a machine frame (4) having substantially parallel longitudinal beams (8), track assemblies (14) at opposite ends of said longitudinal beams (8), said machine frame including a base frame (20), telescopic cross-beams (18) located between said longitudinal beams (8) for adjusting the transverse working width of the paver, said machine frame (4) carrying working means (28, 32) disposed in transverse adjustable relationship to said longitudinal beams (8), said base frame (20) carrying a transverse smoothing beam (150), said transfer smoothing beam (150) including two beam segments (154, 158), and means (156) for pivotally connecting each of said beam segments (154, 158) at substantially the middle of the working width of the paver to form an adjustable roof profile.

33. The slip-form paver as defined in claim 32 wherein one of the beam segments (154, 158) and extension beams (170) connected to the beam segments (154, 158) are provided with transverse slide rails (174) on which the longitudinal beams (8) can slide in the transverse direction whereby the beam segments (154, 158) can project laterally beyond the longitudinal beams (8).

34. The slip-form paver as defined in claim 33 wherein one of the beam segments (154, 158) and extension beams (170) are vertically adjustably connected to the longitudinal beams (8).

* * * * *